US008240885B2

(12) United States Patent
Miller

(10) Patent No.: US 8,240,885 B2
(45) Date of Patent: Aug. 14, 2012

(54) THERMAL MANAGEMENT OF LED LIGHTING SYSTEMS

(75) Inventor: Michael R. Miller, Conyers, GA (US)

(73) Assignee: ABL IP Holding LLC, Conyers, GA (US)

( * ) Notice: Subject to any disclaimer, the term of this patent is extended or adjusted under 35 U.S.C. 154(b) by 343 days.

(21) Appl. No.: 12/621,296

(22) Filed: Nov. 18, 2009

(65) Prior Publication Data

US 2010/0124058 A1 May 20, 2010

Related U.S. Application Data

(60) Provisional application No. 61/199,543, filed on Nov. 18, 2008, provisional application No. 61/156,555, filed on Mar. 2, 2009.

(51) Int. Cl.
*F21V 29/00* (2006.01)

(52) U.S. Cl. ..... 362/294; 362/373

(58) Field of Classification Search ..... 362/294, 362/373, 249.02, 648
See application file for complete search history.

(56) References Cited

U.S. PATENT DOCUMENTS

| | | | |
|---|---|---|---|
| 3,309,565 | A | 3/1967 | Clark et al. |
| 4,168,522 | A | 9/1979 | Laarschot et al. |
| 4,829,771 | A | 5/1989 | Koslow et al. |
| 5,758,823 | A | 6/1998 | Glezer et al. |
| 5,785,418 | A | 7/1998 | Hochstein |
| 5,924,290 | A | 7/1999 | Yoshino |
| 5,957,413 | A | 9/1999 | Glezer et al. |
| 5,988,522 | A | 11/1999 | Glezer et al. |
| 6,012,291 | A | 1/2000 | Ema |
| 6,056,204 | A | 5/2000 | Glezer et al. |
| 6,123,145 | A | 9/2000 | Glezer et al. |
| 6,265,820 | B1 | 7/2001 | Ghosh et al. |
| 6,441,943 | B1 | 8/2002 | Roberts et al. |
| 6,457,654 | B1 | 10/2002 | Glezer et al. |

(Continued)

FOREIGN PATENT DOCUMENTS

| | | |
|---|---|---|
| EP | 1067332 | 1/2001 |

(Continued)

OTHER PUBLICATIONS

Nuventix, "Mechanical Drawing—Low Profile Cooler", http://www.nuventix.com, known to Applicants no later than Nov. 17, 2008.

(Continued)

*Primary Examiner* — Peggy A. Neils
(74) *Attorney, Agent, or Firm* — Kilpatrick Townsend & Stockton LLP

(57) ABSTRACT

Embodiments of the invention provide thermal management systems for LED light fixtures. In one embodiment, an LED track light fixture includes a lighting assembly, a fixture housing mounted to the lighting assembly and having a plurality of apertures, and a mounting structure that affixes the fixture housing to a track. In this embodiment, the lighting assembly includes a heat sink, a reflector, at least one light emitting diode, and a synthetic jet actuator. In a second exemplary embodiment, a sealed, enclosed LED light fixture includes a lighting assembly, along with an enclosure and a fixture housing surrounding the lighting assembly. In this embodiment, the lighting assembly includes at least one light emitting diode, a thermoelectric cooler, and at least one heat sink. In some embodiments, a forced air cooling device may be located between the printed circuit board and the thermoelectric cooler.

11 Claims, 11 Drawing Sheets

U.S. PATENT DOCUMENTS

| | | | | |
|---|---|---|---|---|
| 6,481,874 | B2 | 11/2002 | Petroski | |
| 6,511,209 | B1 | 1/2003 | Chiang | |
| 6,527,422 | B1 | 3/2003 | Hutchison | |
| 6,554,607 | B1 | 4/2003 | Glezer et al. | |
| 6,588,497 | B1 | 7/2003 | Glezer et al. | |
| 6,634,771 | B2 | 10/2003 | Cao | |
| 6,644,598 | B2 | 11/2003 | Glezer et al. | |
| 6,719,446 | B2 | 4/2004 | Cao | |
| 6,746,885 | B2 | 6/2004 | Cao | |
| 6,815,724 | B2 | 11/2004 | Dry | |
| 6,864,513 | B2 | 3/2005 | Lin et al. | |
| 6,960,759 | B2 * | 11/2005 | Konagaya | 250/238 |
| 6,964,501 | B2 * | 11/2005 | Ryan | 362/294 |
| 7,111,963 | B2 | 9/2006 | Zhang | |
| 7,128,421 | B2 | 10/2006 | Slobodin et al. | |
| 7,144,140 | B2 | 12/2006 | Sun et al. | |
| 7,204,615 | B2 | 4/2007 | Arik et al. | |
| 7,208,881 | B2 | 4/2007 | Young | |
| 7,249,868 | B2 | 7/2007 | Chinniah et al. | |
| 7,252,140 | B2 | 8/2007 | Glezer et al. | |
| 7,252,385 | B2 | 8/2007 | Engle et al. | |
| 7,252,678 | B2 | 8/2007 | Ostler et al. | |
| 7,255,460 | B2 | 8/2007 | Lee | |
| 7,263,112 | B2 | 8/2007 | Oomori et al. | |
| 7,275,848 | B2 | 10/2007 | Chinniah et al. | |
| 7,288,796 | B2 | 10/2007 | Dry | |
| 7,336,486 | B2 | 2/2008 | Mongia | |
| 7,344,279 | B2 * | 3/2008 | Mueller et al. | 362/294 |
| 7,478,932 | B2 | 1/2009 | Chinniah et al. | |
| 7,553,028 | B2 * | 6/2009 | Engle et al. | 353/52 |
| 7,606,029 | B2 | 10/2009 | Mahalingam et al. | |
| 7,607,470 | B2 | 10/2009 | Glezer et al. | |
| 7,866,850 | B2 * | 1/2011 | Alexander et al. | 362/294 |
| 8,066,410 | B2 * | 11/2011 | Booth et al. | 362/294 |
| 2004/0026721 | A1 | 2/2004 | Dry | |
| 2005/0128752 | A1 | 6/2005 | Ewington et al. | |
| 2005/0138934 | A1 | 6/2005 | Weigert et al. | |
| 2005/0190557 | A1 | 9/2005 | Zhan et al. | |
| 2005/0243539 | A1 | 11/2005 | Evans et al. | |
| 2005/0279949 | A1 | 12/2005 | Oldham et al. | |
| 2006/0050482 | A1 | 3/2006 | Glezer et al. | |
| 2006/0060331 | A1 | 3/2006 | Glezer et al. | |
| 2006/0086096 | A1 | 4/2006 | Ghoshal | |
| 2006/0088271 | A1 | 4/2006 | Ghoshal | |
| 2006/0151801 | A1 | 7/2006 | Doan et al. | |
| 2006/0192222 | A1 | 8/2006 | Chen et al. | |
| 2006/0198149 | A1 | 9/2006 | Jonsson et al. | |
| 2006/0261351 | A1 | 11/2006 | Nakazato et al. | |
| 2007/0023169 | A1 | 2/2007 | Mahalingam et al. | |
| 2007/0086196 | A1 | 4/2007 | Wong | |
| 2007/0090386 | A1 | 4/2007 | Petrocy | |
| 2007/0096118 | A1 | 5/2007 | Mahalingam et al. | |
| 2007/0102033 | A1 | 5/2007 | Petrocy | |
| 2007/0119573 | A1 | 5/2007 | Mahalingam et al. | |
| 2007/0120138 | A1 | 5/2007 | Sayers et al. | |
| 2007/0139938 | A1 | 6/2007 | Petroski et al. | |
| 2007/0141453 | A1 | 6/2007 | Mahalingam et al. | |
| 2007/0147046 | A1 | 6/2007 | Arik et al. | |
| 2007/0187815 | A1 | 8/2007 | Dai et al. | |
| 2007/0194465 | A1 | 8/2007 | Dai et al. | |
| 2007/0272393 | A1 | 11/2007 | Reichenbach et al. | |
| 2008/0006393 | A1 | 1/2008 | Grimm | |
| 2008/0006843 | A1 | 1/2008 | Dai et al. | |
| 2008/0007696 | A1 | 1/2008 | Engle et al. | |
| 2008/0013320 | A1 | 1/2008 | Tain et al. | |
| 2008/0043061 | A1 | 2/2008 | Glezer et al. | |
| 2008/0043480 | A1 | 2/2008 | Kong | |
| 2008/0062644 | A1 | 3/2008 | Petroski | |
| 2008/0151541 | A1 | 6/2008 | Heffington et al. | |
| 2008/0165535 | A1 | 7/2008 | Mazzochette | |
| 2008/0219007 | A1 | 9/2008 | Heffington et al. | |
| 2008/0253125 | A1 | 10/2008 | Kang et al. | |
| 2008/0265273 | A1 | 10/2008 | Chen | |
| 2008/0298069 | A1 | 12/2008 | Chu | |
| 2008/0304249 | A1 | 12/2008 | Davey et al. | |
| 2009/0284155 | A1 * | 11/2009 | Reed et al. | 315/32 |
| 2010/0038660 | A1 * | 2/2010 | Shuja | 257/98 |

FOREIGN PATENT DOCUMENTS

| | | |
|---|---|---|
| WO | WO-03081127 | 10/2003 |

OTHER PUBLICATIONS

Nuventix, "Mechanical Drawing—Downlighter Module", http://www.nuventix.com, known to Applicants no later than Nov. 17, 2008.

Nuventix, "Mechanical Drawing—MR-16 Cooler", http://www.nuventix.com, known to Applicants no later than Nov. 17, 2008.

Nuventix, "Mechanical Drawing—Top Mount", http://www.nuventix.com, known to Applicants no later than Nov. 17, 2008.

Nuventix, "Mechanical Drawing—PAR 38 Cooler", http://www.nuventix.com, known to Applicants no later than Nov. 17, 2008.

Nuventix, "Products", http://nuventix.com/products/, known to Applicants no later than Nov. 17, 2008.

Nuventix, "SynJet for Philips Fortimo/Lexel LED DLM—Product", http://www.nuventix.com, known to Applicants no later than Nov. 17, 2008.

Nuventix, "SynJet Low Profile Cooler w/HS", http://www.nuventix.com, known to Applicants no later than Nov. 17, 2008.

Nuventix, "SynJet MR 16 LED Cooler w/HS", http://www.nuventix.com, known to Applicants no later than Nov. 17, 2008.

Nuventix, "SynJet PAR-38 LED Cooler", http://www.nuventix.com, known to Applicants no later than Nov. 17, 2008.

Nuventix, "SynJet PAR-38 LED Cooler with Heat Sink", Design Guide, Version 1.0, Oct. 2008 (entire publication), known to Applicants no later than Nov. 17, 2008.

Nuventix, "SynJet Top Mount Chip Cooler w/HS", http://www.nuventix.com, known to Applicants no later than Nov. 17, 2008.

* cited by examiner

THERMAL MANAGEMENT OF LED LIGHTING SYSTEMS

This application claims the benefit of U.S. Provisional Application No. 61/199,543, entitled "LED Track Light with Fanless Cooling," filed Nov. 18, 2008, and U.S. Provisional Application No. 61/156,555, filed Mar. 2, 2009, entitled "Forced Air/Thermoelectric Cooling of Enclosed LEDs," the entire contents of both of which are hereby incorporated by reference.

FIELD OF THE INVENTION

This invention relates to thermal management of light emitting diode-based lighting systems.

BACKGROUND OF THE INVENTION

A light emitting diode ("LED") typically includes a diode mounted onto a die or chip, where the diode is surrounded by an encapsulant. The die is connected to a power source, which, in turn, transmits power to the diode. An LED used for lighting or illumination converts electrical energy to light in a manner that results in very little radiant energy outside the visible spectrum. In a typical LED, a significant portion of the current that is applied to the LEDs is subsequently converted into thermal energy.

In an LED light source, the heat generated by the lamp may cause problems related to the basic function of the lamp and light fixture. Specifically, high operating temperatures degrade the performance of the LED lighting systems. Typical LED lighting systems have lifetimes approaching 50,000 hours at room temperature; however, the same LED lighting system has a lifetime of less than 7,000 hours when operated at close to 90° C.

LEDs are utilized as light sources in a wide variety of applications. Specifically, LEDs may be used in track lighting applications. Track lighting is used to accent or highlight merchandise in such a way that it stands out from the rest of the products around it. Typically, track lighting provides approximately three times more light on a product than the general illumination in the area. In this application, extremely bright LED light sources are used, which produce very high lumens from a relatively small package. LEDs may also be used in sealed, enclosed light fixtures, where the enclosure prevents the possibility of introducing ambient air into the light fixture. In these applications, as well as other LED applications, there is a need to incorporate a cooling system to prevent overheating and to maintain optimum lumen output.

There are three mechanisms for dissipating thermal energy from an LED: conduction, radiation, and convection. Conduction occurs when LED chips, the mechanical structure of the LEDs, the LED mounting structure (such as printed circuit boards), and the light fixture housing are placed in physical contact with one another. Physical contact with the LEDs is generally optimized to provide electrical power and mechanical support. Traditional means of providing electrical and mechanical contact between LEDs and the light fixture provide poor means of conduction between the LEDs and external light fixture surfaces (such as die cast housing). One disadvantage of using a thermally conductive structure within the light fixture envelope is that it allows dissipation of heat into the enclosure, which is generally sealed. This effectively raises the ambient temperature of the air surrounding the LEDs, thus compounding thermal related failures.

Radiation is the movement of energy from one point to another via electromagnetic propagation. Much of the radiant energy escapes the light fixture through the clear optical elements (light emitting zones, lenses, etc) and reflectors, which are designed to redirect the radiant energy (visible light in particular) out of the light fixture according to the needs of the application. The radiant energy that does not escape through the lenses is absorbed by the various materials within the light fixture and converted into heat.

Convection occurs at any surface exposed to air, but may be limited by the amount of air movement near the emitting surface, the surface area available for dissipation, and the difference between the temperature of the emitting surface and the surrounding air. In many cases, the light fixture is enclosed further restricting airflow around the LEDs. In the case of an enclosed light fixture, heat generated by the LEDs is transferred by convection to the air within the enclosure, but cannot escape the boundaries of the enclosure. As a result, the air within the enclosure experiences a build up of heat, which elevates lamp and light fixture temperatures and may lead to heat related failures.

Better thermal management allows the LEDs to be driven at higher power levels while mitigating the negative effects on life and light output normally associated with higher power input levels. Benefits associated with effective removal of thermal energy from within the light fixture include improved lamp life, smaller (lower cost) package sizes, and improved lumen output. Accordingly, there is a need for a cooling system that may be incorporated in LED track light fixtures and enclosed LED light fixture applications to allow LED light fixtures to maintain optimum lumen output.

SUMMARY OF EMBODIMENTS OF THE INVENTION

Embodiments of the invention provide thermal management systems for LED light fixtures. In one embodiment, an LED track light fixture includes a lighting assembly, a fixture housing mounted to the lighting assembly and having a plurality of apertures, and a mounting structure that affixes the fixture housing to a track. In this embodiment, the lighting assembly includes a heat sink with a plurality of fins, a reflector mounted on the heat sink, at least one light emitting diode supported on the heat sink, wherein the at least one light emitting diode is supported to emit light towards the reflector, and a synthetic jet actuator positioned adjacent the heat sink. In some embodiments, the at least one light emitting diode is positioned on a first side of a printed circuit board and a second side of the printed circuit board is mounted to a mounting surface on the heat sink. In some embodiments, a thermal interface material may be positioned between the printed circuit board and the heat sink. In other embodiments, the synthetic jet actuator comprises a plurality of rectangular nozzles that direct air flow across the fins. The rectangular nozzles may direct air flow along a plurality of inner heat sink channels formed between the plurality of fins, while receiving air flow along a plurality of outer heat sink channels formed between the plurality of fins.

In a second exemplary embodiment, a sealed, enclosed LED light fixture includes a lighting assembly, along with an enclosure and a fixture housing surrounding the lighting assembly. In this embodiment, the lighting assembly includes at least one light emitting diode positioned on a first side of a printed circuit board, a thermoelectric cooler with a cold side and a hot side, wherein the cold side is adjacent a second side of the printed circuit board, and at least one heat sink with a first side and second side, wherein the first side of the heat sink is adjacent the hot side of the thermoelectric cooler, and a plurality of fins are mounted to the second side of the heat sink. In some embodiments, a forced air cooling device may be located between the second side of the printed circuit board and the cold side of the thermoelectric cooler, where the forced air cooling device may be but is not limited to a synthetic jet actuator. In other embodiments, an external air movement device may be positioned in the fixture housing adjacent the plurality of fins of the heat sink, where the external air movement device may be but is not limited to a fan or a synthetic jet actuator.

DETAILED DESCRIPTION OF EMBODIMENTS OF THE INVENTION

Embodiments of the invention provide thermal management systems for LED light fixtures. While the thermal management systems are discussed for use with LED track light fixtures and sealed, enclosed LED light fixtures, they are by no means so limited. Rather, embodiments of the thermal management systems may be used in light fixtures of any type.

A. LED Track Lighting Embodiment

Figure 1:
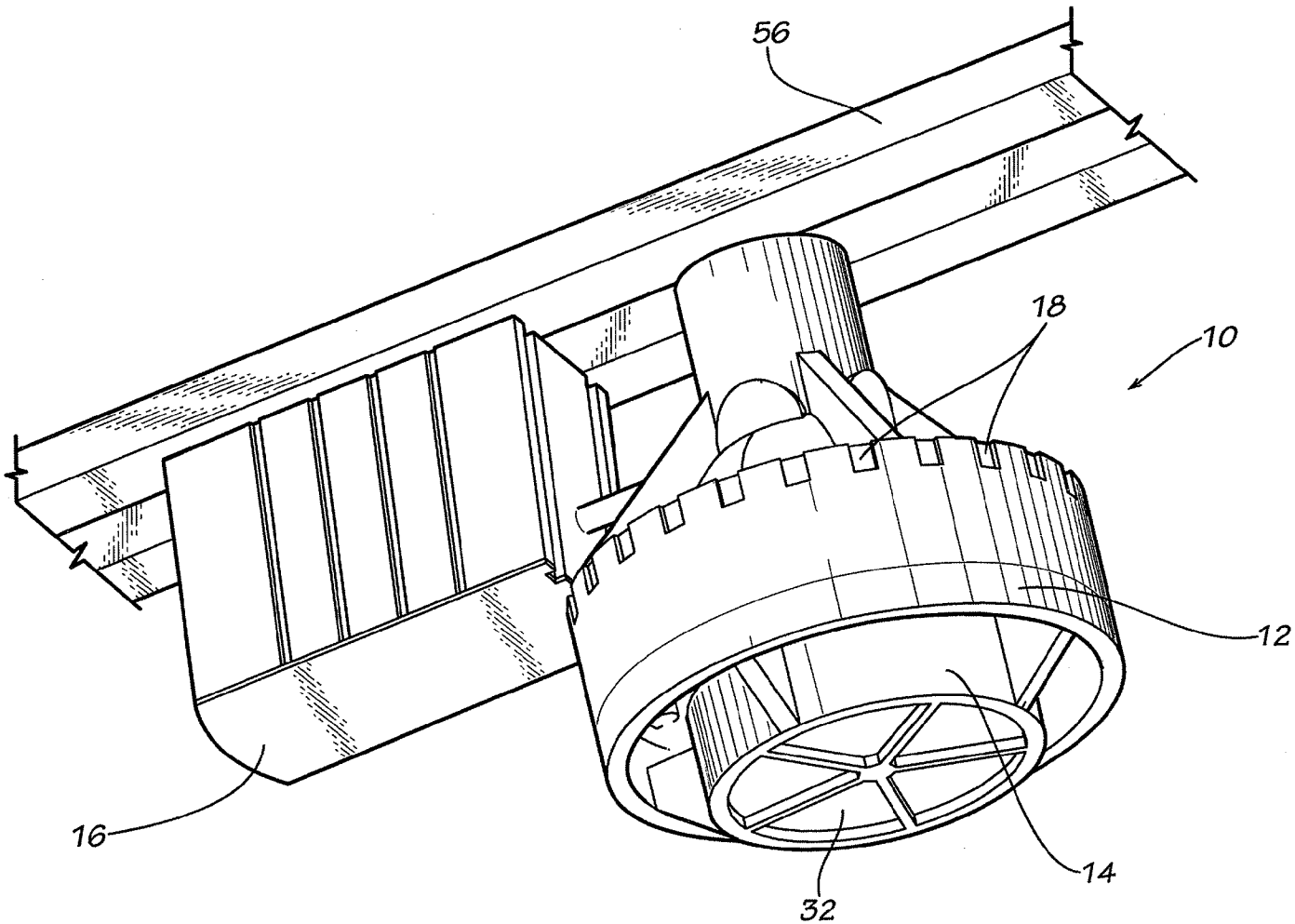
FIG. 1 is a perspective view of an LED track light fixture according to one embodiment of the present invention.
Figure 2:
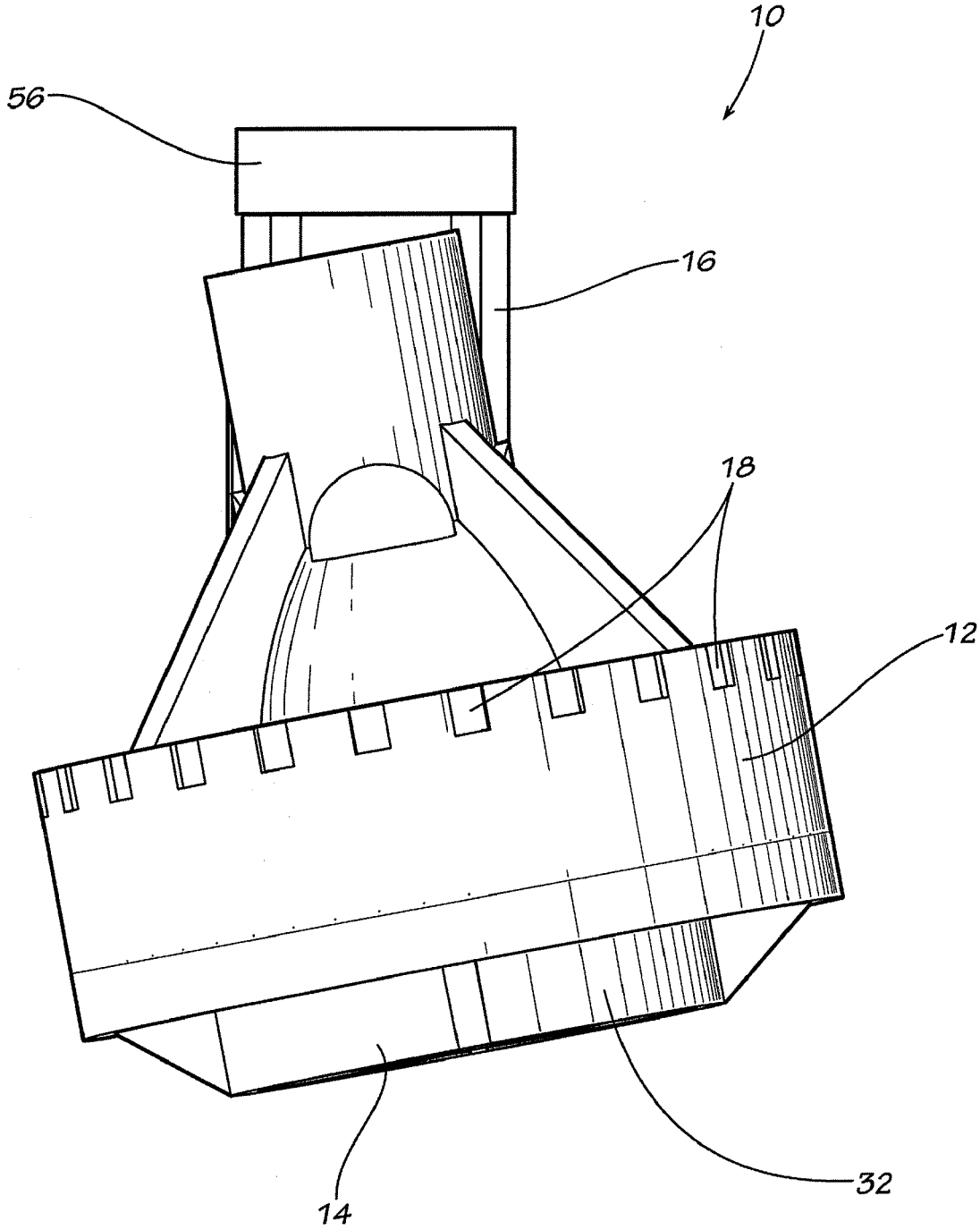
FIG. 2 is a side view of the LED track light fixture of FIG. 1.
Figure 3:
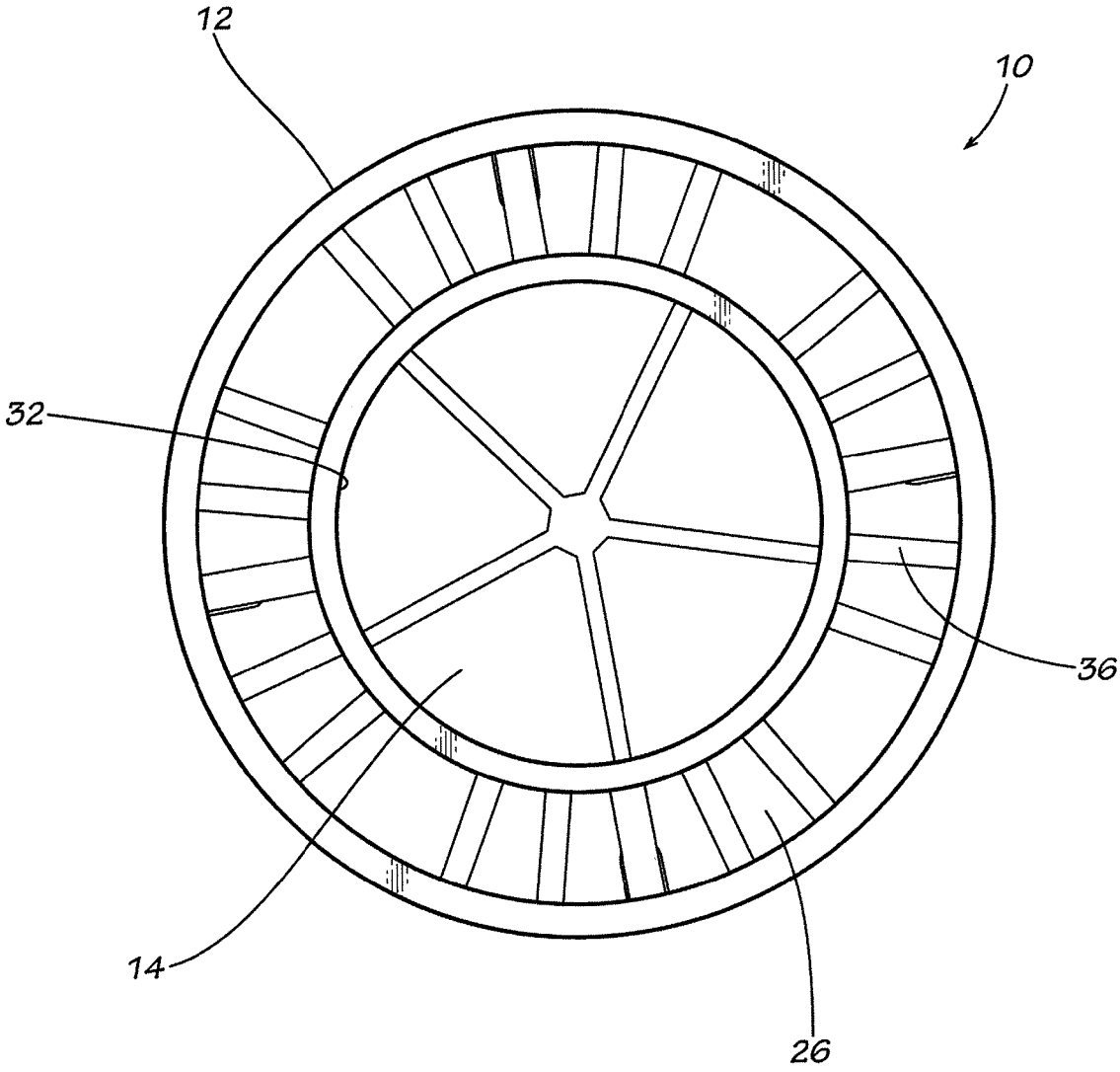
FIG. 3 is a front view of the LED track light fixture of FIG. 1.
Figure 4:
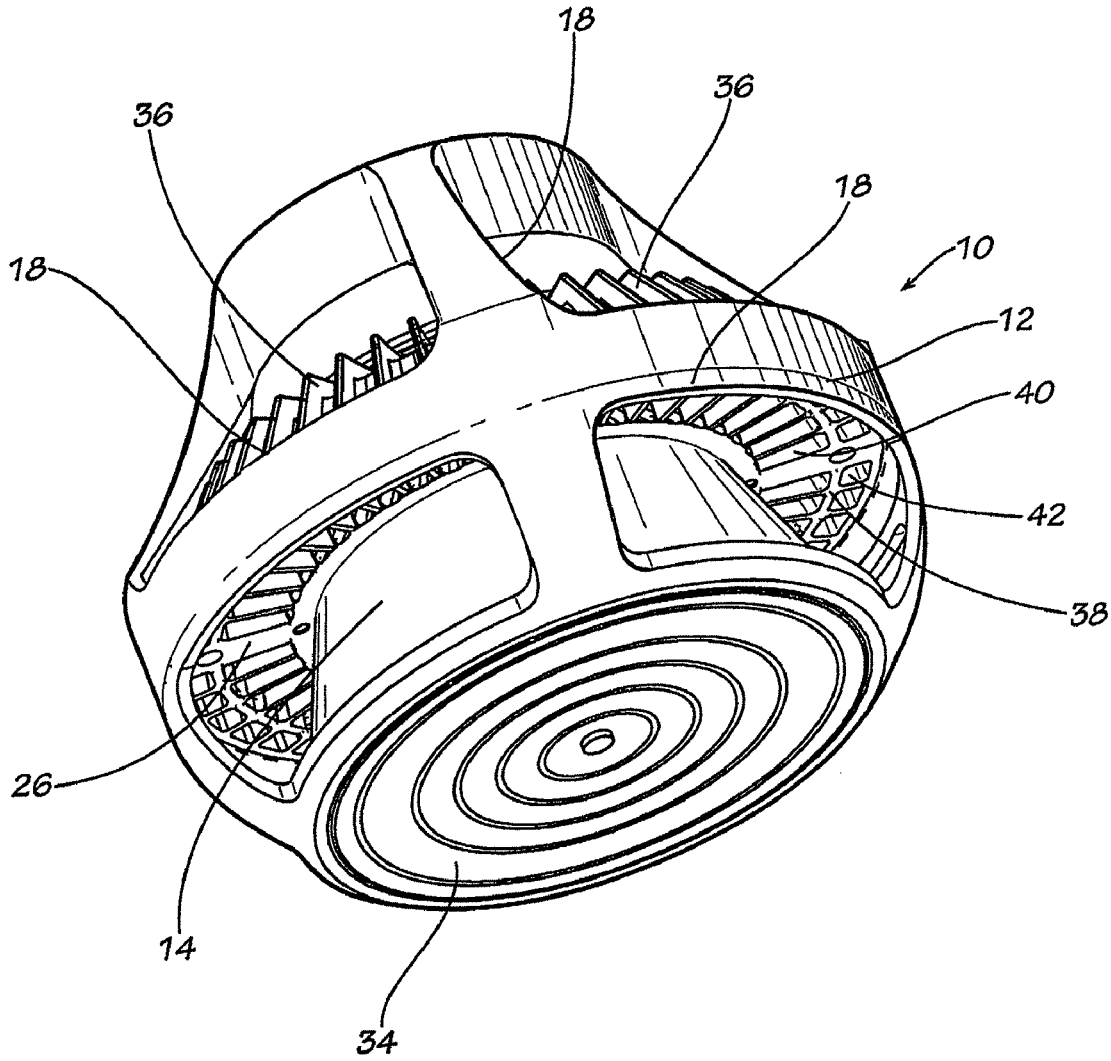
FIG. 4 is a perspective view of an LED track light fixture according to another embodiment of the present invention.
Figure 5:
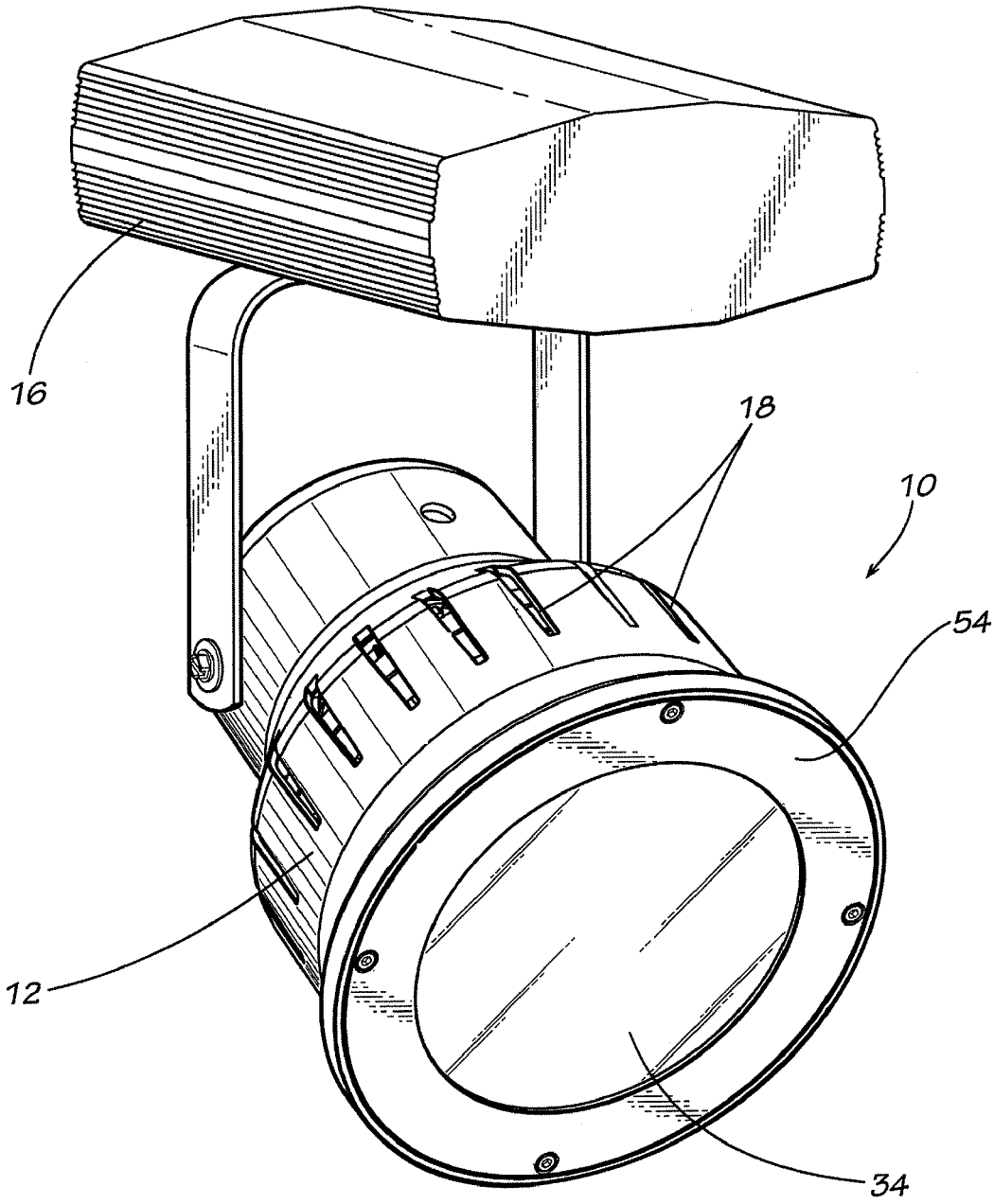
FIG. 5 is a perspective view of an LED track light fixture according to yet another embodiment of the present invention.

FIGS. 1-3 illustrate one embodiment of an LED track light fixture 10. In this embodiment, LED track light fixture 10 includes a fixture housing 12, a lighting assembly 14, and a mounting structure 16. In this embodiment, fixture housing 12 includes a series of apertures 18 that allow air to pass through fixture housing 12. While this embodiment of fixture housing 12 has a cylindrical shape surrounding the lighting assembly 14, the fixture housing 12 may have any shape, including but not limited to parabolic, rectilinear, frustoconical, etc. For example, FIG. 4 illustrates another embodiment of fixture housing 12. In this embodiment, the fixture housing 12 has a generally cage-like structure surrounding the lighting assembly 14. This structure includes numerous large apertures 18 in its surface that allows air to freely circulate around the lighting assembly 14. In addition, FIG. 5 shows yet another embodiment of fixture housing 12. In this embodiment, fixture housing 12 has a general bell shape with apertures 18 that allow air to pass through fixture housing 12.

Figure 6:
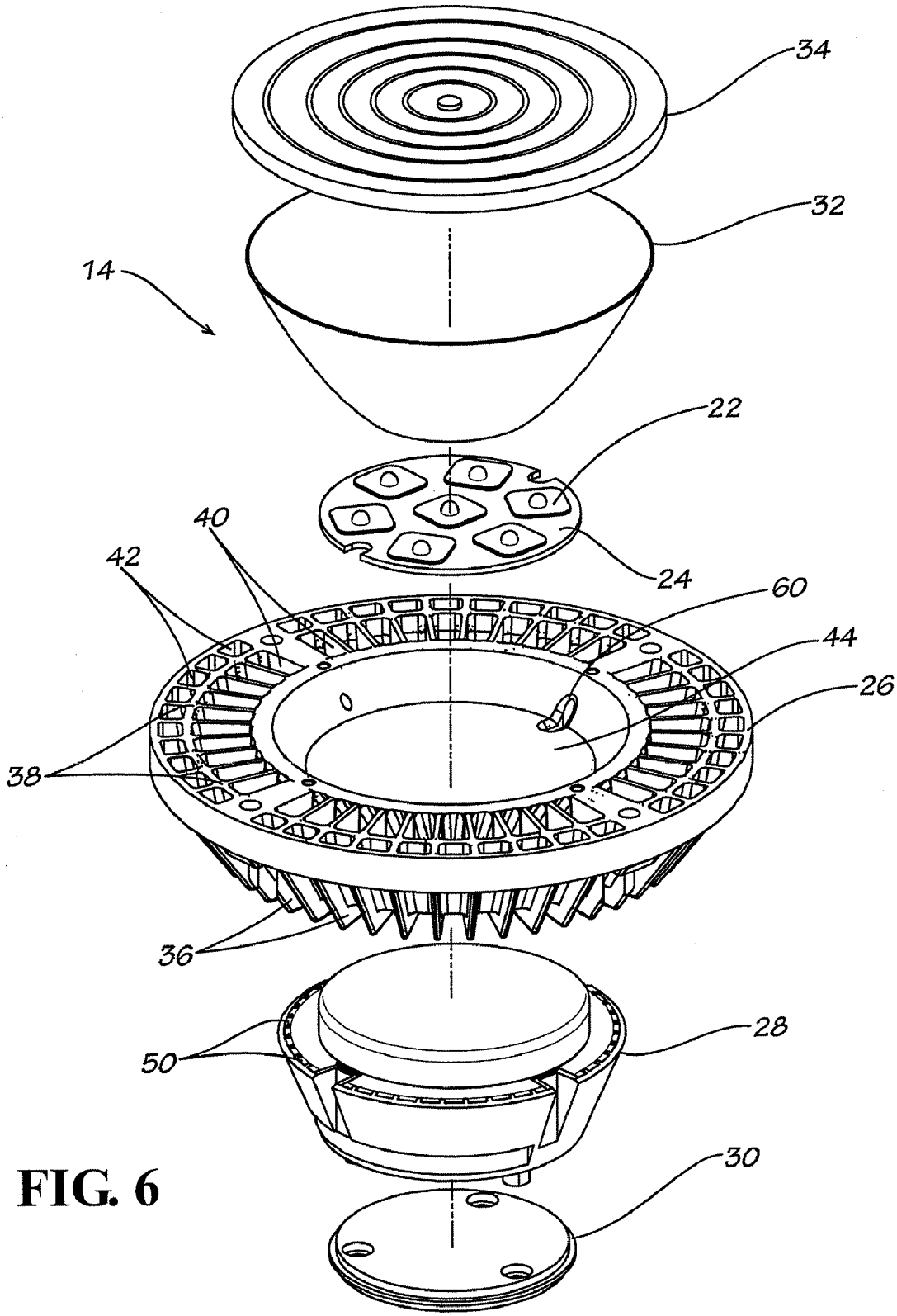
FIG. 6 is an exploded perspective view of an embodiment of a lighting assembly for use in an LED track light fixture.

In some embodiments, as illustrated in FIG. 6, lighting assembly 14 includes at least one LED 22, a printed circuit board ("PCB") 24, a heat sink 26, a synthetic jet actuator 28, a synthetic jet driver 30, a reflector 32, and a lens 34. The LEDs 22 referenced herein can be single-die or multi-die light emitting diodes, DC or AC, or can be organic light emitting diodes ("O-LEDs"). Lighting assembly 14 need not use only white LEDs 22. Rather color or multicolor LEDs 22 may be provided. Nor must all of the LEDs 22 within a lighting assembly 14 be the same color.

The LEDs 22 are mounted on the PCB 24. PCB 24 can be, among other things, metal core board, FR4 board, CHM1 board, etc. Any number of LEDs 22 may be mounted on PCB 24 at any number of locations.

Figure 7:
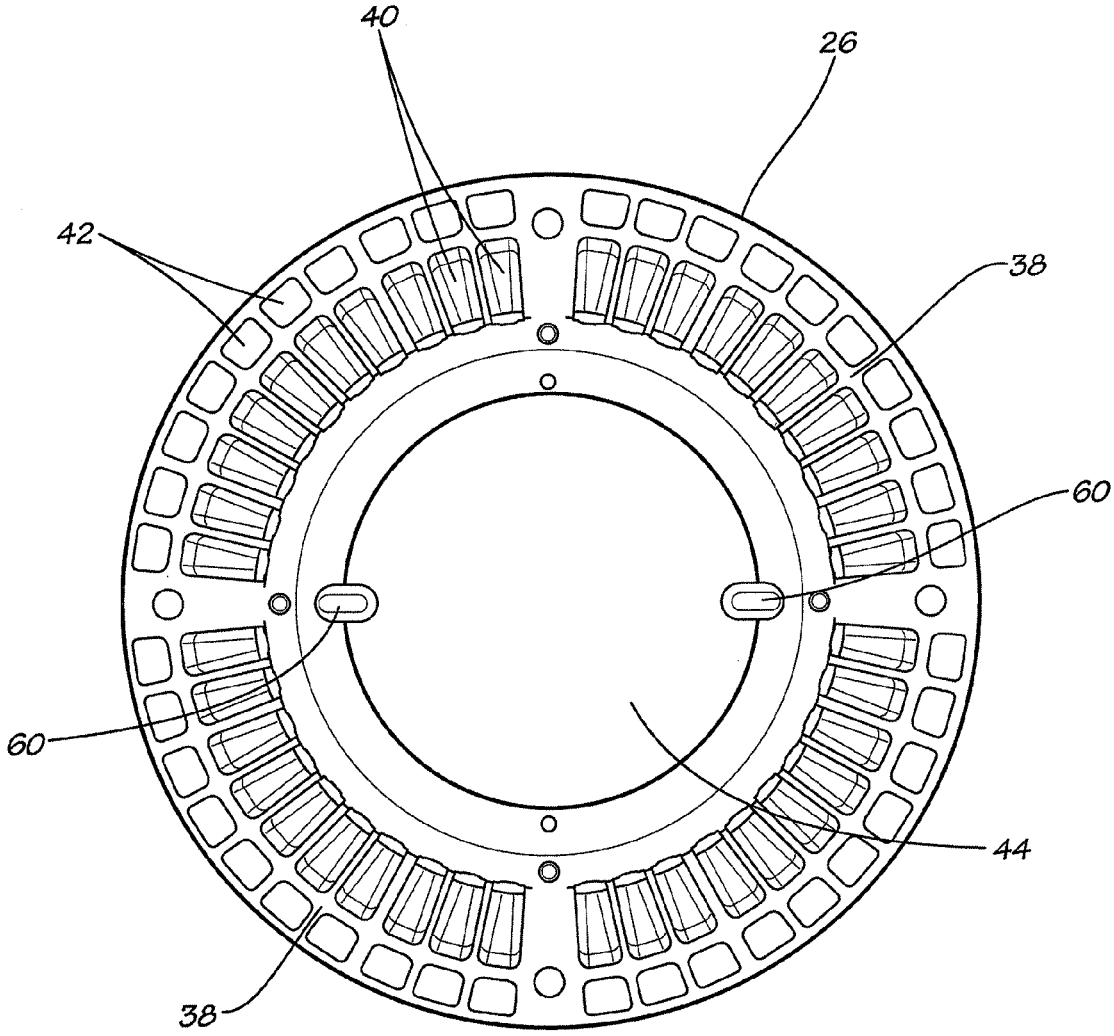
FIG. 7 is a top plan view of the heat sink shown in FIG. 6.

Heat generated by the LEDs 22 is transferred to the PCB 24. To improve the transfer of this heat from PCB 24, the heat sink 26 with radial fins 36 is mounted to the underside of PCB 24. While more fins 36 increase the surface area available for heat transfer and consequently the heat transfer coefficient, any number of fins 36 may be positioned in any configuration, pattern, orientation, and location on heat sink 26. In one embodiment, as shown in FIGS. 6 and 7, fins 36 are divided by an o-ring 38 to create inner heat sink channels 40 and outer heat sink channels 42. Heat sink 26 may be formed from any material having a high coefficient of thermal conductivity including but not limited to aluminum, copper, graphite composite, and a thermally conductive plastic.

Heat sink 26 includes a PCB mounting surface 44 onto which the PCB 24 is mounted. In one non-limiting embodiment, PCB mounting surface 44 is machined and masked with electro-coating in order to make good thermal contact with PCB 24. In some embodiments, a thermal interface material may be included between PCB 24 and PCB mounting surface 44 to improve heat conduction from PCB 24 to heat sink 26. Thermal interface material may be formed from any thermally conductive material including but not limited to thermal grease, paste, thermal epoxy, and thermal pads.

Figure 8:
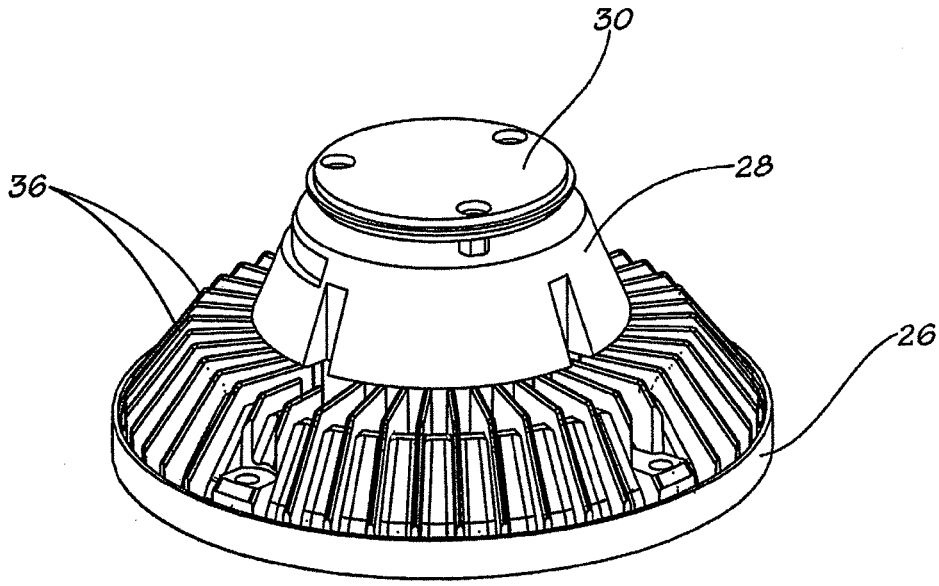
FIG. 8 is a bottom perspective view of the heat sink, synthetic jet actuator, and synthetic jet driver shown in FIG. 6 assembled together.
Figure 9:
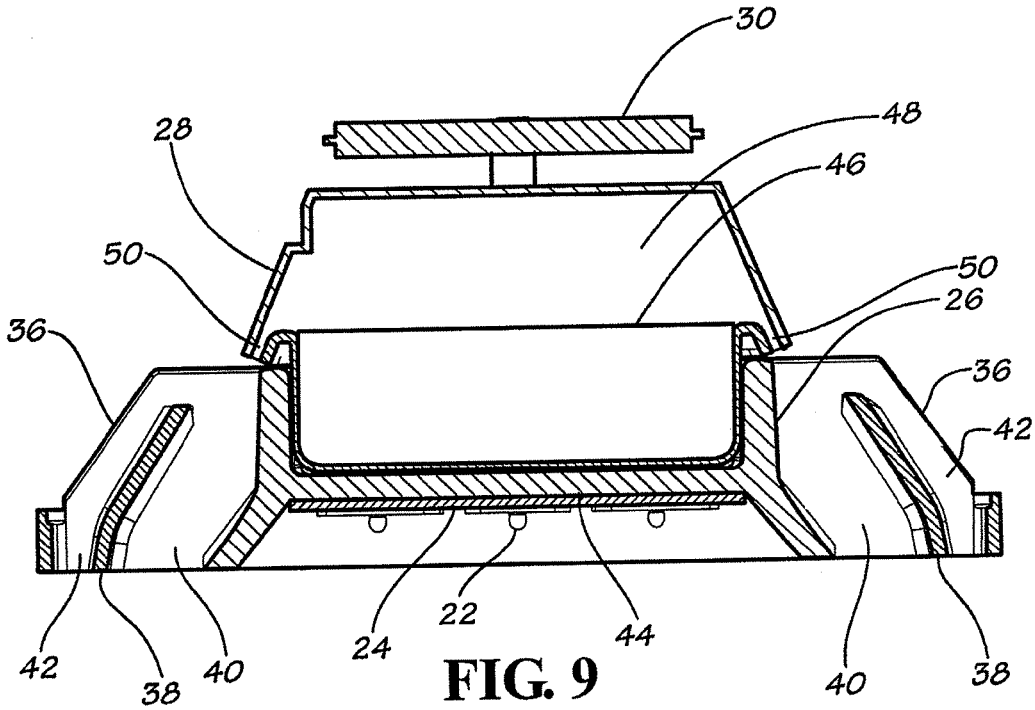
FIG. 9 is a cross-sectional view of the heat sink, synthetic jet actuator, and synthetic jet driver shown in FIG. 6 assembled together.
Figure 10:
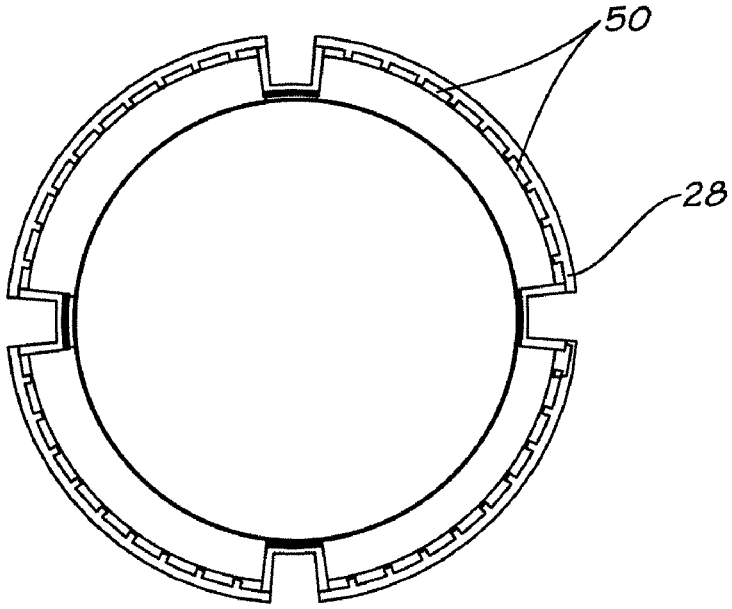
FIG. 10 is a top plan view of the synthetic jet actuator shown in FIG. 6.

In one embodiment, as shown in FIGS. 8-9, the synthetic jet actuator 28 may be mounted to the underside of heat sink 26 to further dissipate heat from the radial fins 36. The synthetic jet actuator 28 and heat sink 26 may be attached together with any suitable mechanical means. In some embodiments, mechanical fasteners, such as screws, pop rivets, or clips, are used to secure synthetic jet actuator 28 to heat sink 26. Synthetic jet actuator 28 creates turbulent pulses of air ("synthetic jets"). The synthetic jets may be developed in a number of ways, such as with an electromagnetic driver, a piezoelectric driver, or even a mechanical driver such as a piston. The synthetic jet driver 30 moves a membrane or diaphragm 46 within the synthetic jet actuator 28 up and down hundreds of times per second, sucking surrounding air into a chamber 48 through a ring of nozzles 50 and then expelling it back through the ring of nozzles 50. In one embodiment, the synthetic jet actuator 28 and heat sink 26 are positioned relative to each other so that nozzles 50 are directed at the inner heat sink channels 40, which are located on the heat sink 26 closest to the PCB 24 and thus closest to the greatest heat concentration on the heat sink 26. The air that is sucked into chamber 48 via nozzles 50 may be entrained through the inner heat sink channels 40, the outer heat sink channels 42, and/or any apertures 18 in the fixture housing 12.

Reflector 32 is positioned over PCB 24 and mounted to heat sink 26. While the illustrated reflector 32 has a dome shape with a 40 degree beam, the reflector 32 may have any shape, including but not limited to rectilinear, frustoconical, cylindrical, etc. In some embodiments, reflector 32 is formed from hydro-formed aluminum, metallized plastic, or other similar material. In other embodiments, reflector 32 is formed from die-cast aluminum, or other similar material. The inner surface of reflector 32 preferably has extremely high surface reflectivity, preferably, but not necessarily, between 96%-99.5%, inclusive and more preferably 98.5-99%. To achieve the desired reflectivity, in one embodiment the inner surface of reflector 32 is coated with a highly reflective material, including but not limited to paints sold under the trade names GL-22, GL-80 and GL-30, all available from DuPont. Other embodiments may utilize textured or colored paints or impart a baffled shape to the reflector surface to obtain a desired reflection. Alternatively, a reflective liner, such as Optilon™ available from DuPont, may be positioned within reflector 32.

In some embodiments, lens 34 is positioned over reflector 32 and mounted thereto. Lens 34 may be formed of any appropriate material that provides the desired lighting effect. In some embodiments, lens 34 is formed of plastic with a diffused surface on one side of the lens and a smooth surface on the opposite side of the lens. In other embodiments, lens 34 is a clear cover to protect the lighting assembly 14, but has no additional optic properties. In yet other embodiments, lens 34 is not included with lighting assembly 14.

Once assembled, lighting assembly 14 can be installed in a fixture housing, including but not limited to the fixture housings 12 shown in FIGS. 1-5. Lighting assembly 14 may be secured to fixture housing 12 by any suitable retention method. In one embodiment, lighting assembly 14 is secured to fixture housing 12 via a mounting ring 54 (see FIG. 5) that attaches to the end of fixture housing 12 after lighting assembly 14 has been inserted to prevent its egress. However, one of skill in the art will understand that any type of fastener may be used. Fixture housing 12 can then be attached to tracks 56 via mounting structure 16. In one embodiment, an LED driver (not shown) to power lighting assembly 14 is provided within mounting structure 16. However, the LED driver may be located in any appropriate location within light fixture 10. In one embodiment, leads from PCB 24 pass through clearance apertures 60 in heat sink 26 and are electrically connected to the LED driver.

B. Sealed, Enclosed Light Fixture Embodiment

Figure 12:
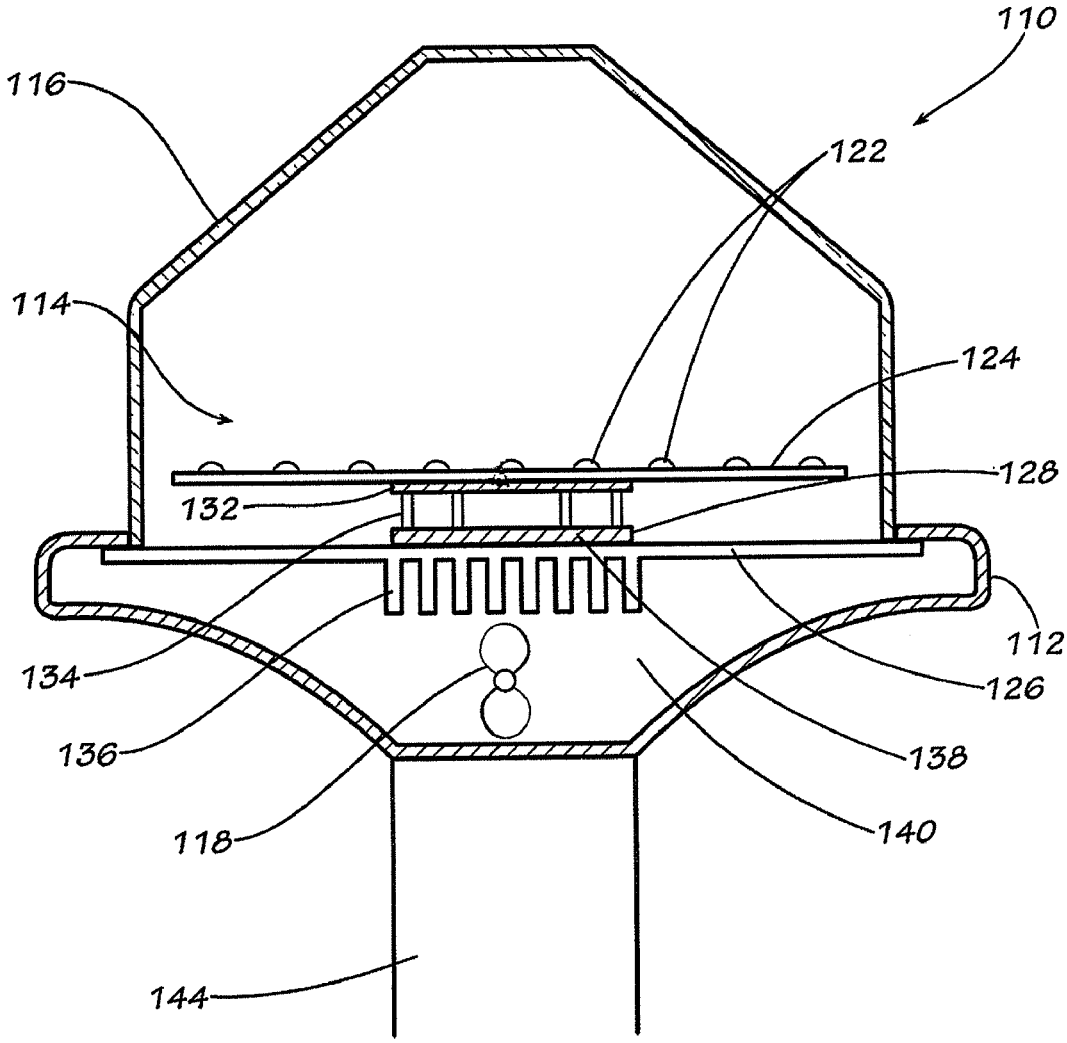
FIG. 12 is a cross-sectional view of an enclosed LED light fixture incorporating a thermoelectric cooler such as shown in FIG. 11.

FIG. 12 illustrates one embodiment of a sealed, enclosed LED light fixture 110. LED light fixture 110 includes a fixture housing 112, a lighting assembly 114, an enclosure 116, and an external air movement device 118. In one embodiment, lighting assembly 114 includes at least one LED 122, a PCB 124, a thermoelectric cooler 128, and a heat sink 126. The above description of LEDs and PCBs, as well as their respective combinations, is incorporated herein with respect to LEDs 122 and PCBs 124. An LED driver (not shown) to power lighting assembly 114 is also contemplated. Leads from PCB 124 would be electrically connected to the LED driver.

Figure 11:
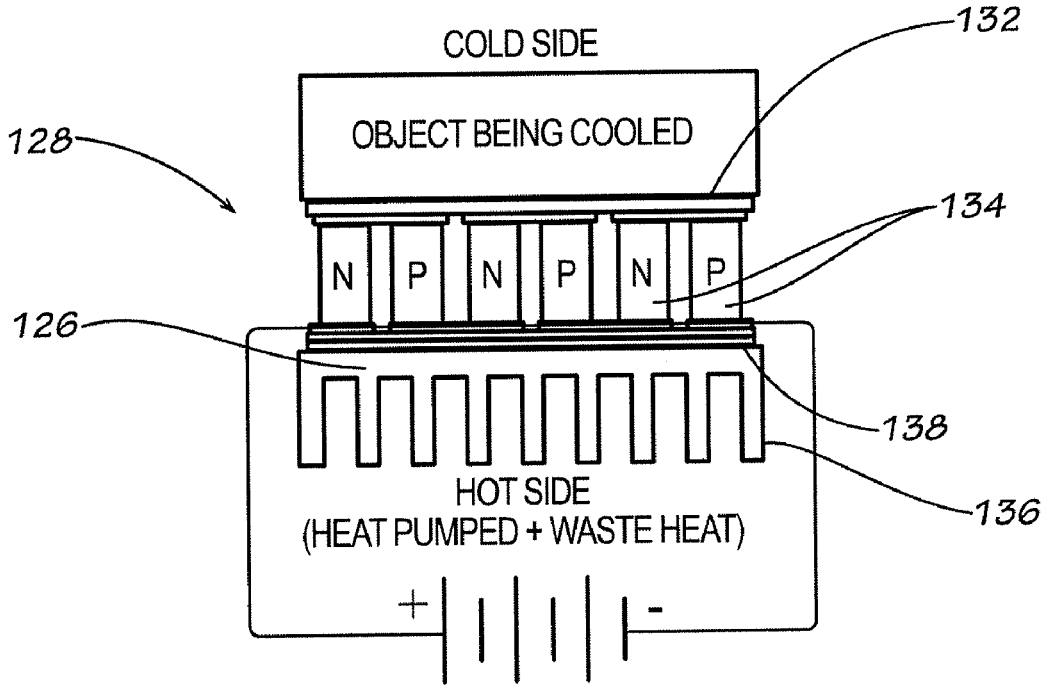
FIG. 11 is a schematic view of a thermoelectric cooler according to one embodiment of the present invention.

In one embodiment, an underside of PCB 124 is connected to a cold side 132 of the thermoelectric cooler 128. In this embodiment, heat is carried away from the underside of PCB 124 via conduction. Thermoelectric cooler 128 is a small solid-state device that functions as a heat pump. As illustrated in FIG. 11, thermoelectric cooler 128 is formed by two ceramic plates (denoted as cold side 132 and hot side 138) connected by an array of small Bismuth Telluride cubes 134 located therebetween. When a DC current is applied to the thermoelectric cooler 128, heat travels from the cold side 132 to a hot side 138.

Figure 13:
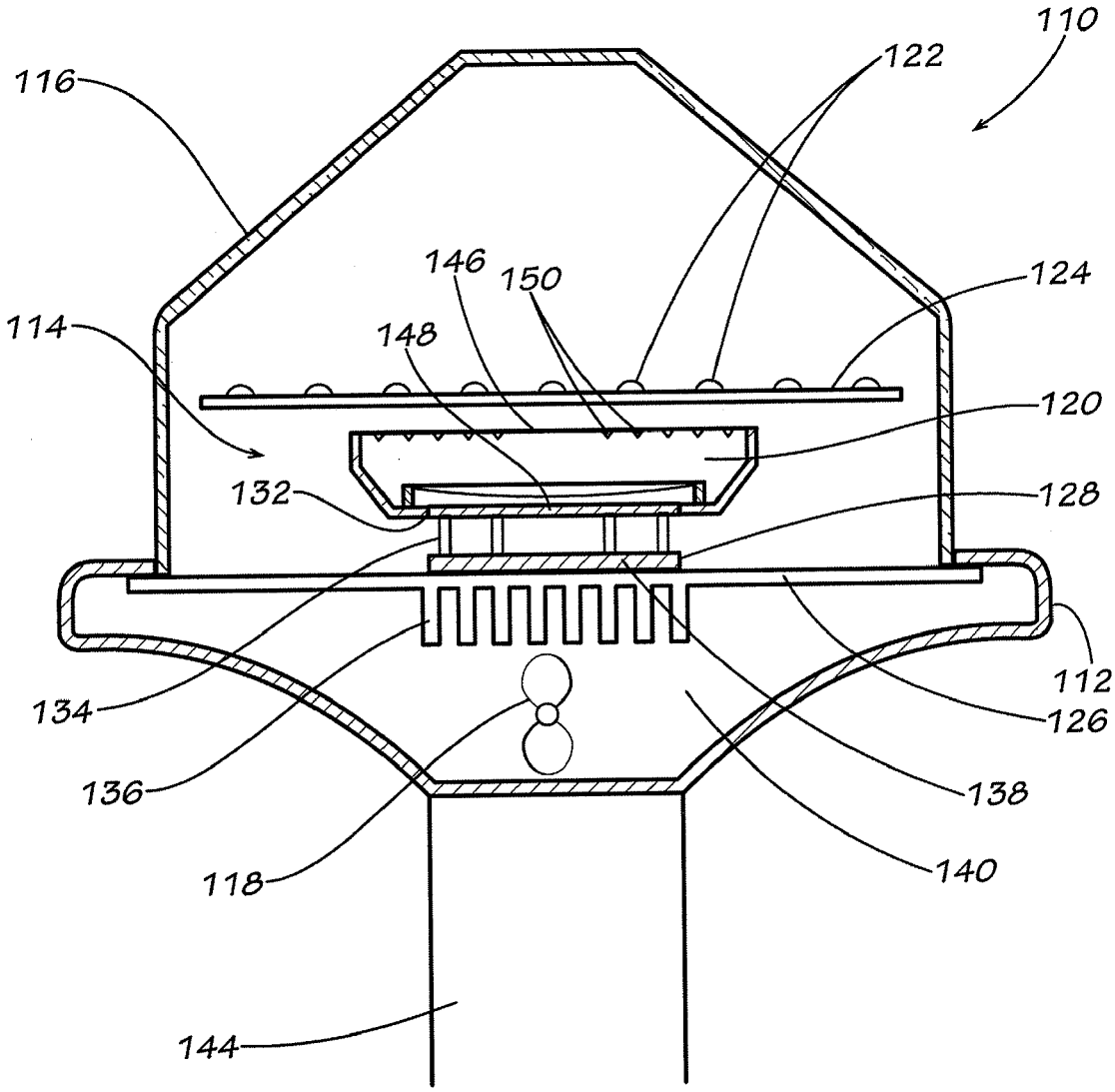
FIG. 13 is a cross-sectional view of the enclosed LED light fixture of FIG. 12 incorporating a synthetic jet actuator.

While FIG. 12 illustrates an embodiment whereby the underside of PCB 124 is connected to the cold side 132 of thermoelectric cooler 128, an alternative embodiment is shown in FIG. 13. In this embodiment, a forced air cooling device 120 (such as a synthetic jet actuator) is positioned between PCB 124 and thermoelectric cooler 128. As a result, the underside of PCB 124 interfaces with the forced air cooling device 120. The interface may be surface-to-surface or other method. One of skill in the art will understand that any type of forced air cooling device 120 may be used to draw hot air away from the underside of PCB 124 and direct the hot air toward the cold side 132 of thermoelectric cooler 128.

In some embodiments, device 120 is a synthetic jet actuator. The synthetic jet actuator 120 creates turbulent pulses of air ("synthetic jets"). The above description of synthetic jet actuators to create the synthetic jets is incorporated herein with respect to synthetic jet actuator 120. Synthetic jet actuator 120 comprises a nozzle surface 146 and a mounting surface 148. The nozzle surface 146 comprises a plurality of nozzles 150 that direct air flow away from the underside of PCB 124. The mounting surface 148 of synthetic jet actuator 120 is connected to the cold side 132 of the thermoelectric cooler 128.

Heat sink 126 is attached to the hot side 138 of thermoelectric cooler 128. Heat sink 126 preferably (but not necessarily) includes fins 136. The heat sink 126 may have any shape, size, configuration, including but not limited to that of the heat sink 26.

Enclosure 116 is positioned over lighting assembly 114 and mounted to heat sink 126 to form a sealed, enclosed environment surrounding lighting assembly 114. While the illustrated enclosure 116 has a polygonal shape, enclosure 116 may have any shape, including but not limited to dome, rectilinear, etc. In some embodiments, enclosure 116 is formed from glass, plastic, or other similar material that provides suitable optical properties, as well as allowing visible light to escape the enclosure.

Heat sink 126 is also mounted to fixture housing 112. In one embodiment, fins 136, which extend outside of the sealed, enclosed environment surrounding lighting assembly 114, extend into a cavity 140 formed between the heat sink 126 and fixture housing 112. In some embodiments, an external air movement device 118 may be (but does not have to be) located within cavity 140 to increase the heat transfer from fins 136 to the outside environment. Examples of external air movement devices include but are not limited to fans, synthetic jet actuators, etc. Air vents (not shown) may also be located on the surface of fixture housing 112 to provide additional circulation of air within cavity 140. In other embodiments, an external air movement device 118 is not included and all heat removal from cavity 140 is accomplished via venturi effect created by the air vents. Fixture housing 112 may also be mounted to a post 144, where post 144 may function as a large heat fin to further dissipate heat from LED light fixture 110.

The foregoing is provided for purposes of illustrating, explaining, and describing embodiments of the present invention. Further modifications and adaptations to these embodiments will be apparent to those skilled in the art and may be made without departing from the scope or spirit of the invention.

I claim:

1. An enclosed LED light fixture comprising:

a. a lighting assembly comprising:

i. at least one light emitting diode positioned on a first side of a printed circuit board;

ii. a thermoelectric cooler comprising a cold side and a hot side, wherein the cold side of the thermoelectric cooler is adjacent a second side of the printed circuit board;

iii. a forced air cooling device that is located between the second side of the printed circuit board and the cold side of the thermoelectric cooler; and iv. a heat sink comprising a first side and a second side, wherein the heat sink is mounted to the thermoelectric cooler so that the first side of the heat sink is adjacent the hot side of the thermoelectric cooler and wherein a plurality of fins extend from the second side of the heat sink; and b. an at least partially transparent enclosure and a fixture housing that surround the lighting assembly.

2. The enclosed LED light fixture of claim 1, wherein the forced air cooling device comprises a synthetic jet actuator.

3. The enclosed LED light fixture of claim 1, wherein the heat sink is mounted to the fixture housing.

4. The enclosed LED light fixture of claim 1, further comprising an air movement device positioned in the fixture housing adjacent the plurality of fins of the heat sink.

5. The enclosed LED light fixture of claim 4, wherein the air movement device comprises a fan or a synthetic jet actuator.

6. The enclosed LED light fixture of claim 1, wherein the enclosure is mounted to the first side of the heat sink to form a sealed, enclosed environment.

7. An enclosed LED light fixture comprising:

a. a lighting assembly comprising:

i. at least one light emitting diode positioned on a first side of a printed circuit board;

ii. a synthetic jet actuator comprising a nozzle surface and a mounting surface, wherein the nozzle surface of the synthetic jet actuator is adjacent a second side of a printed circuit board;

iii. a thermoelectric cooler comprising a cold side and a hot side, wherein the cold side of the thermoelectric cooler is affixed to the mounting surface of the synthetic jet actuator; and iv. a heat sink comprising a first side and a second side, wherein the heat sink is mounted to the thermoelectric cooler so that the first side of the heat sink is adjacent the hot side of the thermoelectric cooler and wherein a plurality of fins extend from the second side of the heat sink; and b. an at least partially transparent enclosure and a fixture housing that surround the lighting assembly.

8. The enclosed LED light fixture of claim 7, further comprising a plurality of nozzles on the nozzle surface of the synthetic jet actuator that direct air flow away from the second side of the printed circuit board.

9. The enclosed LED light fixture of claim 7, further comprising an external air movement device positioned in the fixture housing adjacent the plurality of fins of the heat sink.

10. The enclosed LED light fixture of claim 9, wherein the external air movement device comprises a fan or a synthetic jet actuator.

11. The enclosed LED light fixture of claim 7, wherein the enclosure is mounted to the first side of the heat sink to form a sealed, enclosed environment.

* * * * *